US007753808B2

(12) United States Patent
Matsunaga

(10) Patent No.: US 7,753,808 B2
(45) Date of Patent: Jul. 13, 2010

(54) GOLF CLUB HEAD

(75) Inventor: Hideo Matsunaga, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 735 days.

(21) Appl. No.: 11/264,155

(22) Filed: Nov. 2, 2005

(65) Prior Publication Data

US 2006/0111198 A1 May 25, 2006

(30) Foreign Application Priority Data

Nov. 25, 2004 (JP) ..... P2004/340911

(51) Int. Cl.
*A63B 53/04* (2006.01)

(52) U.S. Cl. ..... 473/342; 473/329

(58) Field of Classification Search ..... 473/324–350
See application file for complete search history.

(56) References Cited

U.S. PATENT DOCUMENTS 6,354,962 B1 * 3/2002 Galloway et al. ..... 473/342
6,623,377 B2 * 9/2003 Evans et al. ..... 473/342

FOREIGN PATENT DOCUMENTS

| | | | |
|---|---|---|---|
| JP | 9-192273 | A | 7/1997 |
| JP | H09-192273 | A | 7/1997 |
| JP | 2001-346916 | A | 12/2001 |
| JP | 2003-38690 | A | 2/2003 |
| JP | 2004-501688 | A1 | 1/2004 |
| JP | 2005-124745 | A | 5/2005 |
| WO | 02/00308 | A1 | 1/2002 |

OTHER PUBLICATIONS

"Centroid," www.Bookrags.com.*
Japanese Patent Office Action issued Nov. 12, 2009.

* cited by examiner

*Primary Examiner*—Alvin A Hunter
(74) *Attorney, Agent, or Firm*—Sughrue Mion, PLLC

(57) ABSTRACT

A golf club head includes a portion with different thickness in a face portion. A region having a maximum thickness and a region having a minimum thickness are formed on a back of the face portion. An inclined portion with varying thickness is provided between those regions.

4 Claims, 4 Drawing Sheets

GOLF CLUB HEAD

BACKGROUND OF THE INVENTION

1. Field of the Invention

The present invention relates to a golf club head having a portion with different thickness in a face portion.

2. Description of the Related Art

A conventional metallic golf club head having a portion with different thickness in a face portion was disclosed in JP-A-9-192273. The golf-club head of JP-A-9-192273 has a thickness $T_1$ of a central part 3 including a sweet spot of a face forming portion 2 to be formed strong enough to withstand an impact with the ball, and the thickness $T_2$, $T_3$ of the peripheral parts 4, 5 of the central part 3 smaller than that of the central part 3 to have a spring property over the entire face, as shown in FIG. 5.

The golf club head of JP-A-9-192273 has a reduced weight while keeping the strength of the face portion, whereby the size of the head is increased by allocating the reduced weight, or the size of the head is increased without changing the weight of the head. Also, the entire face portion is given a spring property by reducing the thickness of the peripheral part of the face portion, so that the repulsion of the ball is more excellent.

However, the golf club head as described in JP-A-9-192273 was not fully satisfied in the respects of the weight reduction effect, repellency and strength of the face portion, because there was a step difference between the thicker portion and the thinner portion, the thickness of the central part was quite large, and the relationship between the area of the thicker portion and the area of the thinner portion was not minutely examined.

This invention has been achieved in the light of the above-mentioned problems, and it is an object of the invention to provide a golf club head having a portion with different thickness in a face portion, in which the golf club head is fully satisfied in the respects of the weight reduction effect, repellency and strength of the face portion.

SUMMARY OF THE INVENTION

The invention provides a golf club head characterized by including an inclined portion with varying thickness on the back of a face portion.

The golf club head of the invention is formed with a region having the maximum thickness and a region having the minimum thickness on the back of the face portion, and provided with the inclined portion with varying thickness between the regions.

In the invention, the inclined portion is varied in thickness continuously or discontinuously. Also, in the invention, the region having the maximum thickness and the region having the minimum thickness may be suitably uniform in thickness.

In the golf club head of the invention, suitably, the inclined portion exists outside the region having the maximum thickness and the region having the minimum thickness exists outside the inclined portion.

Also, in the invention, it is preferable in the respect of repellency that the region having the maximum thickness includes a center of figure of the face portion. The center of figure of the face portion means the center of gravity of the face portion.

In the invention, it is preferable that the thickness of the region having the maximum thickness is 2.1 to 4.5 mm, particularly 2.5 to 3.6 mm, and the thickness of the region having the minimum thickness is 1 to 2.6 mm, particularly 1.3 to 2.1 mm. If the thickness of the region having the maximum thickness exceeds 4.5 mm, the rigidity of the face portion may become too high, and if the thickness of the region having the minimum thickness is less than 1 mm, there is a problem in the respects of strength and manufacture. Also, a difference in thickness between the region having the maximum thickness and the region having the minimum thickness is suitably 0.8 to 3.5 mm, particularly 1 to 2.5 mm.

In the invention, it is preferable that the area of the region having the maximum thickness is 2 to 12%, particularly 2 to 8% of the area of the face portion, and the area of the region having the minimum thickness is 15 to 60%, particularly 30 to 50% of the area of the face portion. Also, it is suitable that the area of the region having the maximum thickness is 3 to 50%, particularly 5 to 30% of the area of the region having the minimum thickness. The area of the face portion is about 35 to 55 $cm^2$ for the number 1 wood, for example.

The method for manufacturing the golf club head of the invention is not specifically limited, but the face opening portion of the head main body may be closed with the face member. In this case, the material or molding method of the head main body is not limited, but suitably, the material may be titanium, titanium alloy, stainless steel, or amorphous, and the molding method may be a forging method, a press forming method for press working the plate, or a die casting method. Also, the method for joining the head main body and the face member is not specifically limited, but the laser welding or electron beam welding is preferably employed because the juncture part is finished cleanly and the weight precision of the golf club head is enhanced.

The golf club head of the invention may be formed into a wood type golf club head having a hollow portion or an iron type golf club head. When it is formed into the wood type golf club head, the head volume is about 300 to 470 $cm^3$ for the number 1 wood, for example.

The golf club head of the invention is superior in the respects of the weight reduction effect, repellency and strength of the face portion. Also, the golf club head of the invention is improved in the off-center performance and expanded in the high repulsion area by setting the thickness or area of the region having the maximum thickness and the region having the minimum thickness in the specific range.

BRIEF DESCRIPTION OF THE DRAWINGS

FIG. 1A is a front view, and FIG. 1B is a cross-sectional view of a face portion;

FIG. 2A is a front view, and FIG. 2B is a cross-sectional view of the face portion;

FIGS. 4A and 4B show a golf club head of the comparative example, in which FIG. 4A is a front view and FIG. 4B is a cross-sectional view of the face portion.

DETAILED DESCRIPTION OF THE INVENTION

The preferred embodiments of the present invention will be described below with reference to the drawings. However, the invention is not limited to the following embodiments.

Figures 1A, 1B:
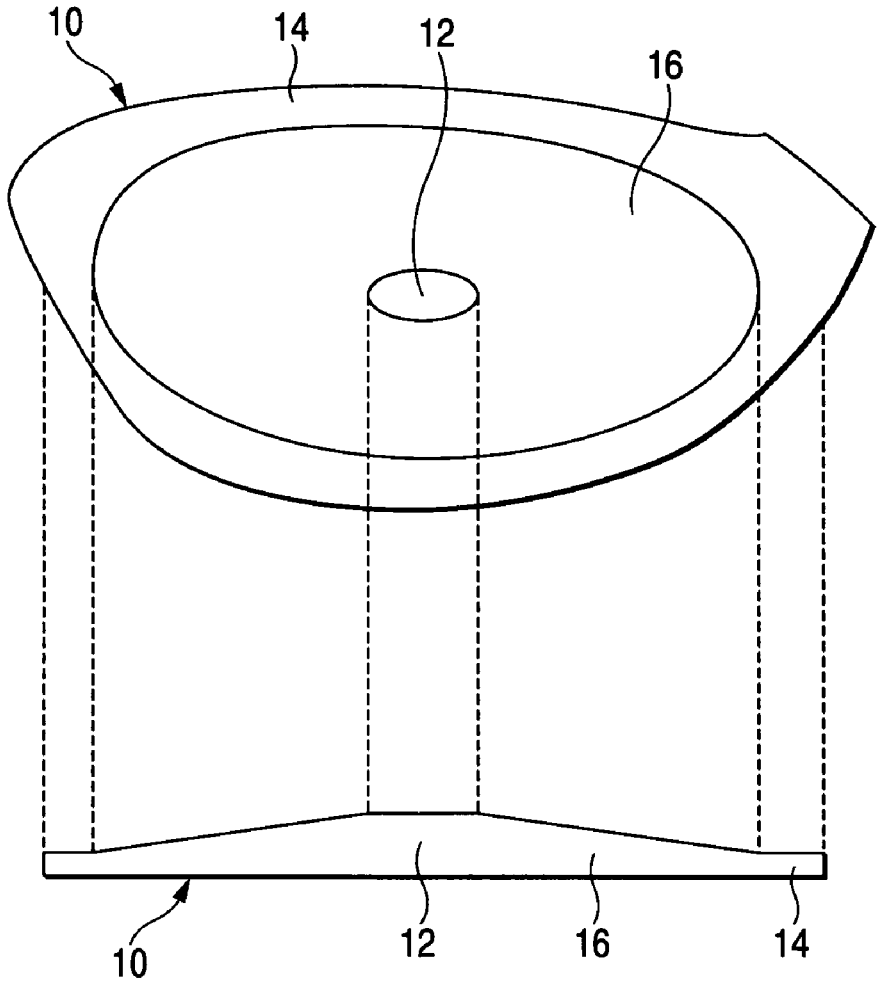
FIGS. 1A and 1B show a golf club head according to one embodiment of the invention.

FIGS. 1A and 1B show a golf club head according to one embodiment of the invention, in which FIG. 1A is a front view, and FIG. 1B is a cross-sectional view of a face portion. The golf club head of this embodiment is formed with a region 12 having the maximum thickness and a region 14 having the minimum thickness on the back of the face portion 10, and provided with an inclined portion 16 having continuously varying thickness between both regions 12 and 14. The region 12 having the maximum thickness includes a center of figure of the face portion, in which the inclined portion 16 exists outside the region 12 having the maximum thickness, and the region 14 having the minimum thickness exists outside the inclined portion 16.

Specifically, in the golf club of this embodiment, the thickness of the region having the maximum thickness is 3.3 mm, the thickness of the region having the minimum thickness is 2.1 mm, the area of the region having the maximum thickness is 2.3% of the area of the face portion, and the area of the region having the minimum thickness is 37.6% of the area of the face portion. Also, the face portion and the head main body are made of titanium alloy.

Figures 2A, 2B:
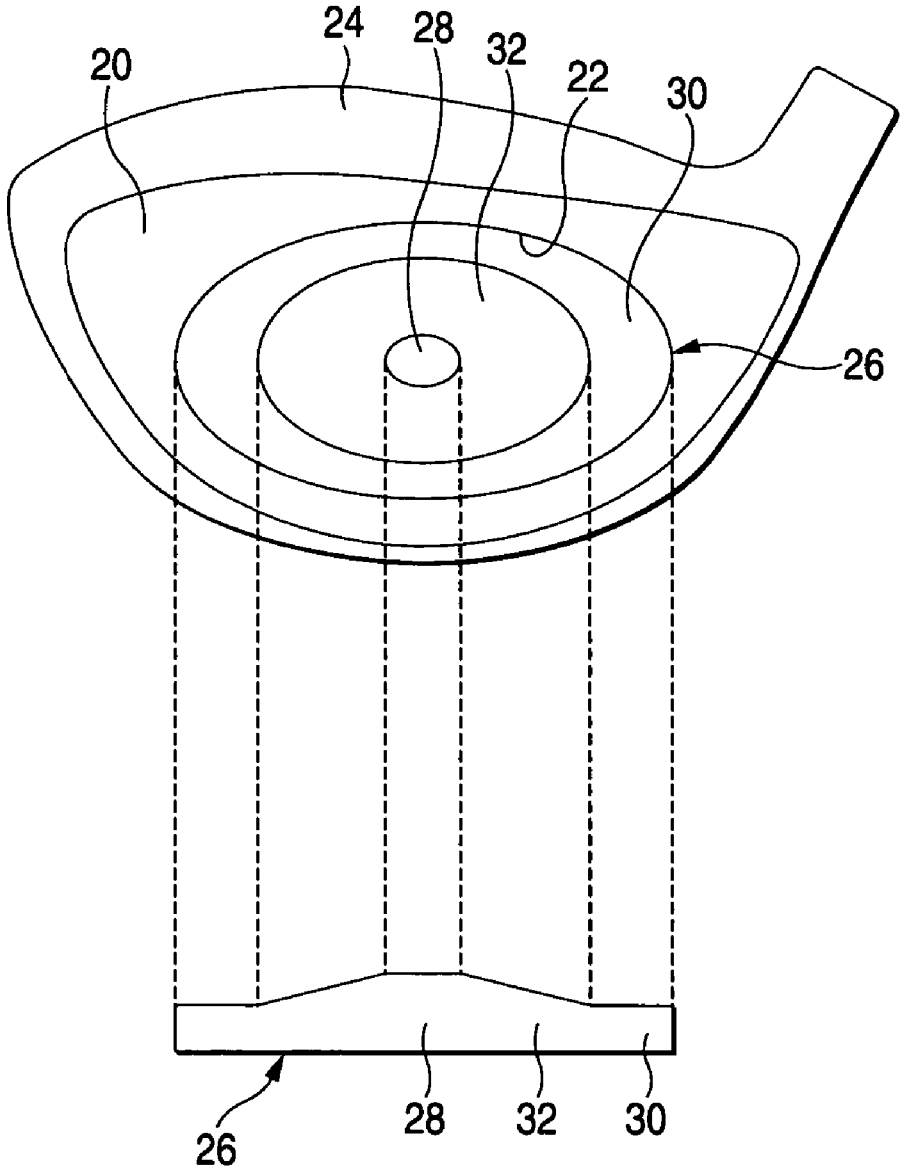
FIGS. 2A and 2B show a golf club head according to another embodiment of the invention.

FIGS. 2A and 2B show a golf club head according to another embodiment of the invention, in which FIG. 2A is a front view, and FIG. 2B is a cross-sectional view of a face portion. The golf club head of this embodiment includes a head main body 24 having a face portion 20 and a face opening portion 22, and a face member 26 for closing the face opening portion 22. The golf club head of this embodiment is formed with a region 28 having the maximum thickness and a region 30 having the minimum thickness on the back of the face portion 26, and provided with an inclined portion 32 having continuously varying thickness between both regions 28 and 30. The region 28 having the maximum thickness includes a center of figure of the face portion 20, in which the inclined portion 32 exists outside the region 28 having the maximum thickness, and the region 30 having the minimum thickness exists outside the inclined portion 32.

Specifically, in the golf club of this embodiment, the thickness of the region having the maximum thickness is 3.1 mm, the thickness of the region having the minimum thickness is 1.8 mm, the area of the region having the maximum thickness is 2.3% of the area of the face portion, and the area of the region having the minimum thickness is 48% of the area of the face portion. Also, the face member and the head main body are made of titanium alloy.

A 50 m/s bazooka endurance test was conducted as a strength test for the face portion, using the golf club head (embodiment) as shown in FIGS. 1A and 1B, in which the restitution coefficient near the sweet spot of the face portion was measured. For comparison, the same measurements were conducted, employing the golf club head (comparative example 1) of FIGS. 4A and 4B corresponding to the club of JP-A-9-192273 and the golf club head (comparative example 2) that is the same as the golf club head as shown in FIGS. 1A and 1B except that the thickness of the face portion is uniform (2.8 mm thick).

Figure 4A:
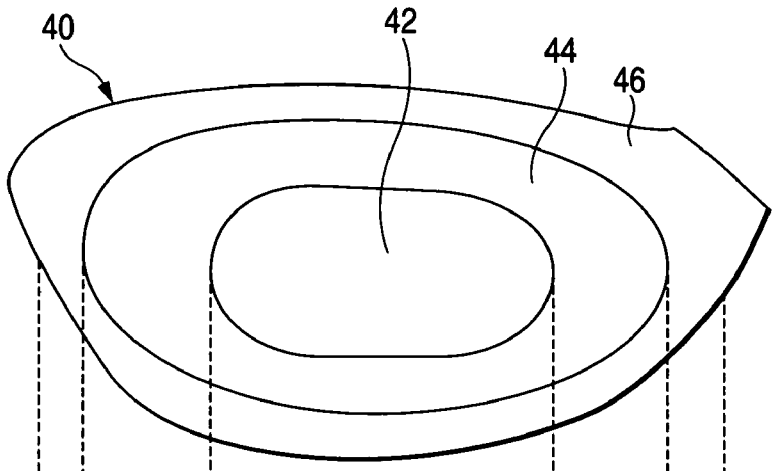
FIG. 4A RELATED ART
Figure 4B:
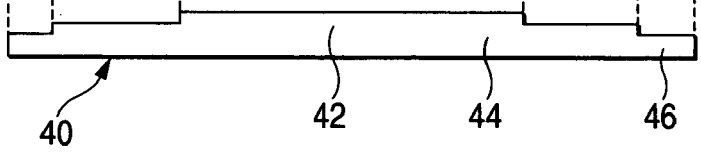
FIG. 4B RELATED ART
Figure 5:
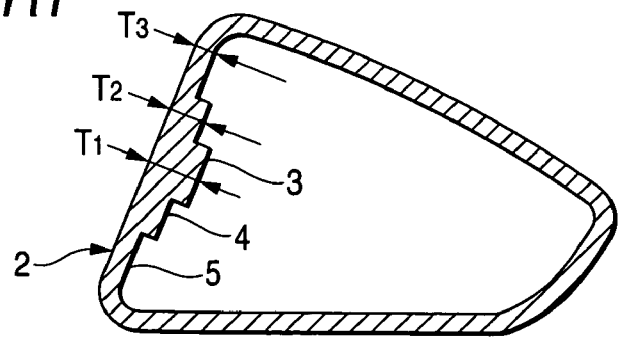
FIG. 5 RELATED ART
FIG. 5 is a cross-sectional view showing one example of the conventional golf club head.

In the golf club head of FIGS. 4A and 4B, a region 44 having an intermediate thickness (2.6 mm thick) is formed outside a region 42 having the maximum thickness (3.0 mm thick) in a face portion 40, and a region 46 having the minimum thickness (2.4 mm thick) is formed outside the region 44 having the intermediate thickness. The region 42 having the maximum thickness in the golf club head of FIGS. 4A and 4B has a larger area and a smaller thickness than the region 28 having the maximum thickness in the golf club head of FIGS. 2A and 2B. The region 46 having the minimum thickness in the golf club head of FIGS. 4A and 4B has a larger thickness than the region 30 having the minimum thickness in the golf club head of FIGS. 2A and 2B. The upper surface of each region is flat. Other points are the same as the golf club head of FIGS. 1A and 1B.

Figure 3:
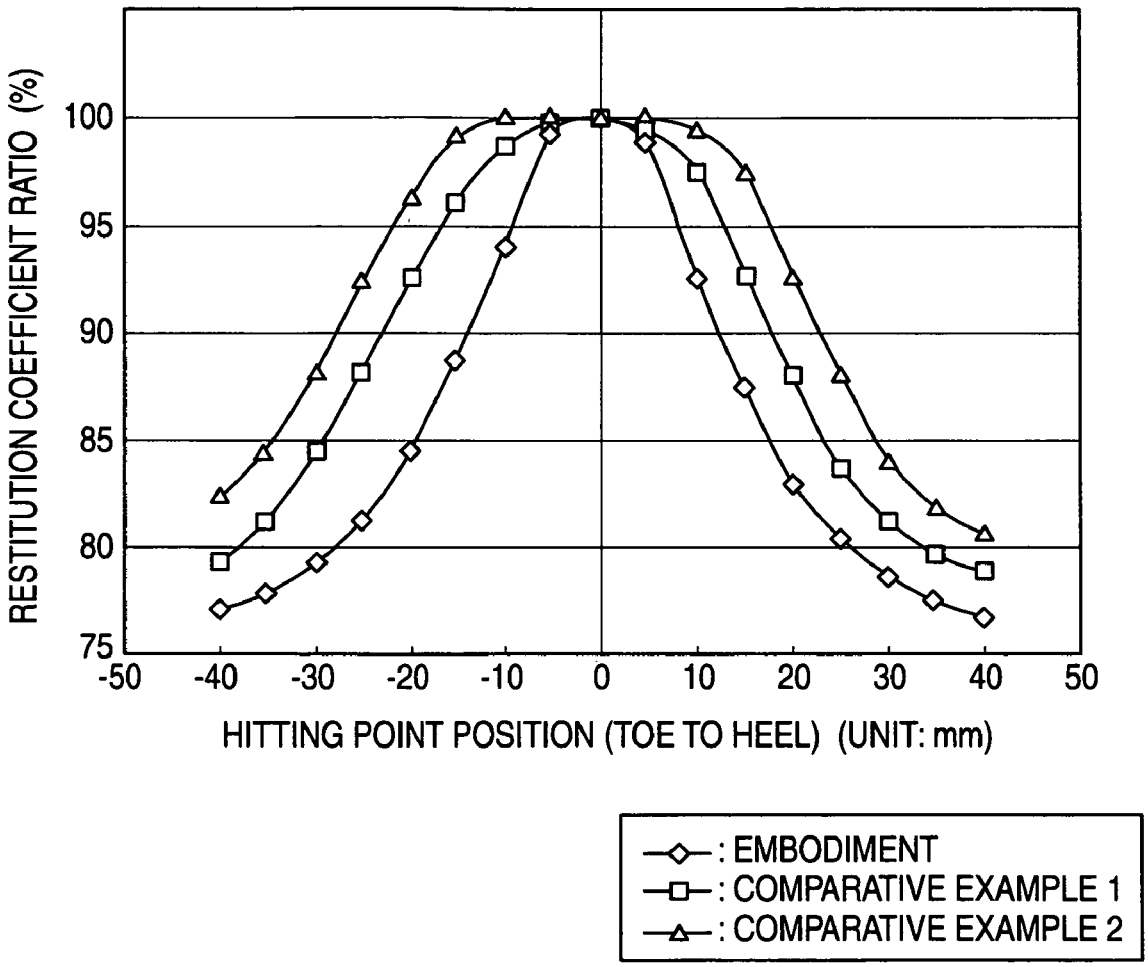
FIG. 3 is a graph showing the measurement results of restitution coefficient of the face portion in each of the golf club heads of the example and the comparative examples.

The weight of the face portion and the result of the 50 m/s bazooka endurance test for each of the golf club heads in the example and the comparative examples are listed in Table 1 below. Also, the measurement results of the restitution coefficient near the sweet spot of the face portion are shown in FIG. 3. The vertical axis of FIG. 3 represents a restitution coefficient ratio when the restitution coefficient of 0.834 is 100%.

TABLE 1

| | Example | Comparative example 1 | Comparative example 2 |
|---|---|---|---|
| Weight of face portion | 45 g | 50 g | 55 g |
| Strength (50 m/s bazooka endurance Test) | No breakage at 3000 times | Breakage (crack, void) at 2300 times | Breakage (crack, void) at 2000 times |

From the results of Table 1, it will be found that the reduced weight and the increased strength of the face portion can be made according to the invention. Also, from the results of FIG. 3, it will be found that the off-center performance of the face portion is increased and the high repulsion area is expanded.

What is claimed is:

1. A golf club head comprising:

an inclined portion with continuously varying thickness on a back of a face portion;

wherein a first region having a maximum thickness and a second region having a minimum thickness are formed on the back of the face portion the inclined portion with continuously varying thickness is provided between the first region and the second region;

wherein the first region having the maximum thickness includes a centroid of the face portion;

wherein an area of the first region having the maximum thickness is 2 to 12% of an area of the face portion, and an area of the second region having the minimum thickness is 15 to 60% of the area of the face portion.

2. The golf club head according to claim 1, wherein the inclined portion exists outside the first region having the maximum thickness, and the second region having the minimum thickness exists outside the inclined portion.

3. The golf club head according to claim 1, wherein the face portion is molded by a forging method, a press forming method or a die casting method.

4. The golf club head according to claim 1, wherein the inclined portion with continuously varying thickness has an incline which varies linearly from the first region to the second region.

* * * * *